US005892445A

United States Patent [19]

Tomich

[11] Patent Number: 5,892,445

[45] Date of Patent: Apr. 6, 1999

[54] HIGHWAY WORKER SAFETY SIGNAL DEVICE

[76] Inventor: Rudy G Tomich, 22105 E. Tara Rd., Benton City, Wash. 99320

[21] Appl. No.: 775,178

[22] Filed: Dec. 31, 1996

[51] Int. Cl.[6] ..... G08B 23/00

[52] U.S. Cl. ..... 340/573; 340/321; 340/908; 340/908.1; 116/209; 362/108; 362/190; 40/586

[58] Field of Search ..... 340/573, 321, 340/331, 332, 908, 908.1; 116/209, 173, 28 R, 63 P, 202; 441/89; 362/108, 103, 190, 191; 40/586

[56] References Cited

U.S. PATENT DOCUMENTS

| | | | |
|---|---|---|---|
| 1,723,147 | 8/1929 | Fourethier | 340/321 |
| 1,777,379 | 10/1930 | Powell et al. | 340/321 |
| 1,839,113 | 12/1931 | Mitchell et al. | 340/321 |
| 2,473,394 | 6/1949 | Scott | 340/321 |
| 2,705,751 | 4/1955 | Harris et al. | 340/321 |
| 3,122,736 | 2/1964 | Weber | 340/321 |
| 3,153,745 | 10/1964 | Gurian et al. | 340/321 |
| 3,435,412 | 3/1969 | Bohrer, Sr. | 340/321 |
| 4,035,856 | 7/1977 | Oberg . | |
| 4,598,661 | 7/1986 | Roe . | |
| 4,985,813 | 1/1991 | Putman | 340/321 |
| 5,070,436 | 12/1991 | Alexander et al. | 340/321 |
| 5,083,956 | 1/1992 | Chraghchian et al. | 116/209 |
| 5,337,041 | 8/1994 | Friedman . | |
| 5,423,282 | 6/1995 | Krull . | |
| 5,651,711 | 7/1997 | Samamo | 116/173 |
| 5,694,110 | 12/1997 | Clifford | 340/321 |

*Primary Examiner*—Nina Tong
*Attorney, Agent, or Firm*—Johnnie R. Hynson

[57] ABSTRACT

The instant invention is a harness-attached light mechanism that is visible from a distance or and in inclement weather. It consists of a harness assembly that supports a flash assembly. The flash assembly is a battery powered strobe or other light affixed atop a pole by a flexible means that allows easy movement, or waving, of the light. The light mechanism attracts the attention of on-coming motorist thereby increasing his safety. The pole is supported by a harness that is fitted to the wearer.

8 Claims, 5 Drawing Sheets

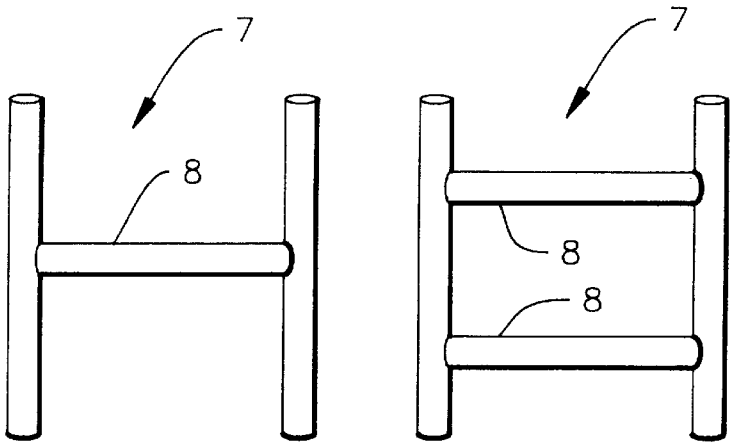
Fig. 2a
Fig. 2b
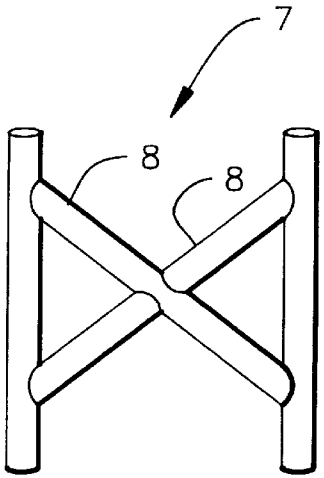
Fig. 2c
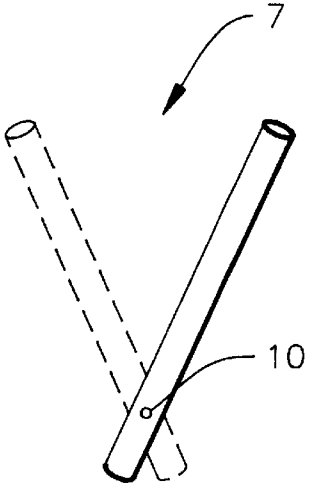
Fig. 2d
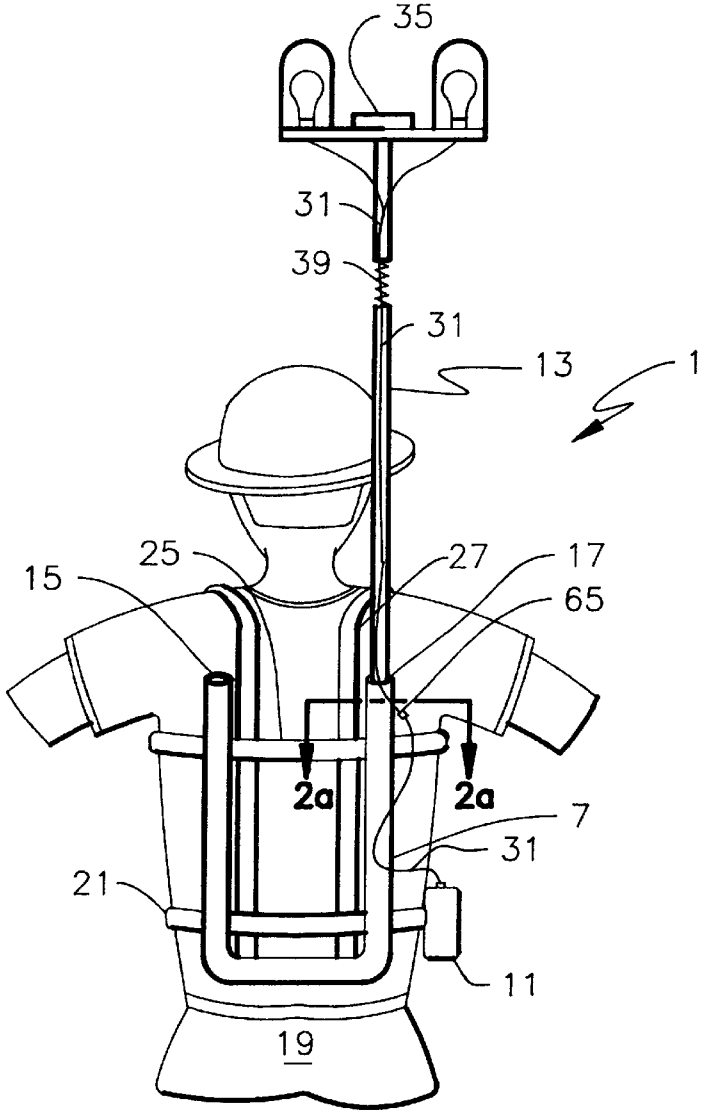
Fig. 1

HIGHWAY WORKER SAFETY SIGNAL DEVICE

FIELD OF INVENTION

The present invention relates generally to an apparatus for the protection of highway workers. Particularly, it relates a harness-attached light mechanism that attracts the attention of on-coming motorist, and is visible from a distance, and in inclement weather.

BACKGROUND OF THE INVENTION

While working on highway, the workers attention is generally directed at the ground level. This diverts the attention of the worker from traffic on the road under repair. This causes danger to the worker.

Several types of warning devices have been used that have partially solved the problem. For example, bright colored or florescent vests, and road barriers with lights. The lights used have been both flashing or steady.

Other attempts that have been more successful in solving this problem include vests with a pole attached, along with a brightly colored flag affixed near the tip of the pole. However, this type of device has limitations.

For example, the vest is hot and cumbersome for a person performing labor. Also, the flag cannot be seen in conditions of reduced visibility.

The instant invention solves these problems and protects the highway worker in any type of condition, while being more comfortable and easy to use.

SUMMARY OF THE INVENTION

The instant invention is a harness-attached light mechanism that is visible from a distance, and in inclement weather. It consist of a harness assembly that support a flash assembly. The flash assembly is a strobe or other light that is affixed atop a pole by flexible means that allows easy movement of the light. The pole is supported by a harness that is fitted to the wearer.

The subject matter of the present invention is particularly pointed out and distinctly claimed in the concluding portion of the specification. However, both the organization and method of operation, together with further advantages and objects thereof, may best understood by reference to the following description taken in connection with accompanying drawings wherein like reference characters refer to like elements.

BRIEF DESCRIPTION OF THE DRAWINGS

FIG. 1 is an isometric view of the highway worker safety signal device as worn on a worker.

FIG. 2*a* is an isometric view of an H-shaped pole support member.

FIG. 2*b* is an isometric view of an multi-beam reenforced pole support member.

FIG. 2*c* is an isometric view of an cross-beam pole support member.

FIG. 2*d* is an isometric view of a variable position pole support member.

DESCRIPTION OF THE PREFERRED EMBODIMENTS

Referring to FIG. 1, the instant invention is a highway worker safety signal device 1 worn by highway workers during construction and repairs. The highway worker safety signal device 1 comprises a harness assembly 3 and a flash assembly 5.

Harness Assembly

Figure 3:
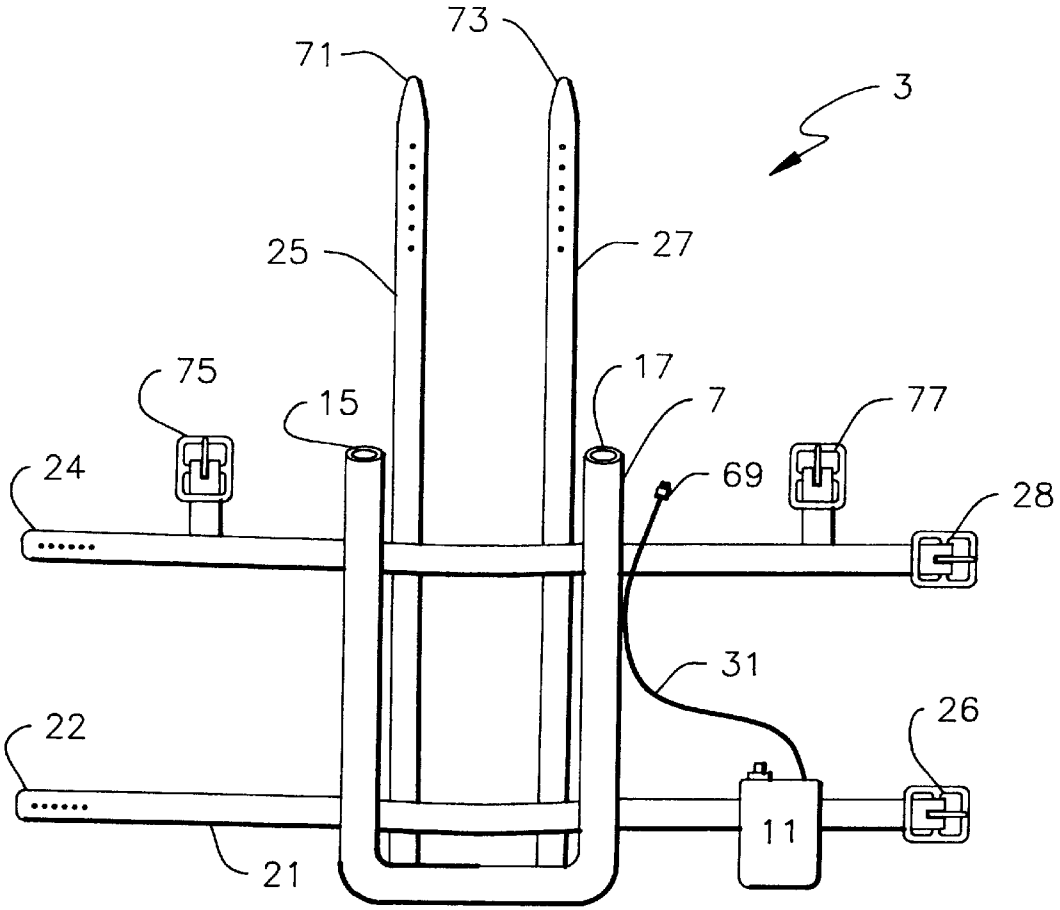
FIG. 3 is a top view of the harness assembly.

Now referring to FIG. 3 the harness assembly 3 is constructed of three principal sections. The pole support member 7 which is used to directly support the flash assembly 5; the support strap assembly 9; and the power pack 11.

Pole Support Member

The pole support member 7 is typically constructed of pliable-hollow metal or plastic tubing, and is mounted directly to the support strap assembly 9. The pole support member and pole should both be constructed of a strong light weight material such as high-impact plastic.

Now referring to FIGS. 2*a*, 2*b*, and 2*c* the pole support member 7 is preferred to be an easy fabricated shape. Referring only to FIG. 2*a* an H-shaped pole support member 7 provides additional pole positions. Referring to FIG. 2*b* and FIG. 2*c* cross-beam supports can be placed between openings to give additional support. In each of the embodiments cross-beams and supports 8 of various configurations can be used when necessary to increase the stability of the pole support member 7. A U-shaped pole support member 7 (shown in FIG. 1) can also be used.

Now referring to FIG. 2*d* a variable position pole support member can be used. This embodiment can be particularly useful in conditions of limited mobility, or when additional items worn by the work interfere with the position of pole 13. In the variable position embodiment a pivot point 10 is utilized.

The means of attachment of the pole support member to the harness assembly is not germane to the instant invention, but it should be either adhesive or brads that is known in the art.

Pole Support Member Support a Pole

Now referring again to FIG. 1, it should be noted that when the pole 13 is placed in either the first opening 15 or the second opening 17 of the pole support member 7 it will protrude upward from the wearer to a height determined by the length of the pole.

Figure 4:
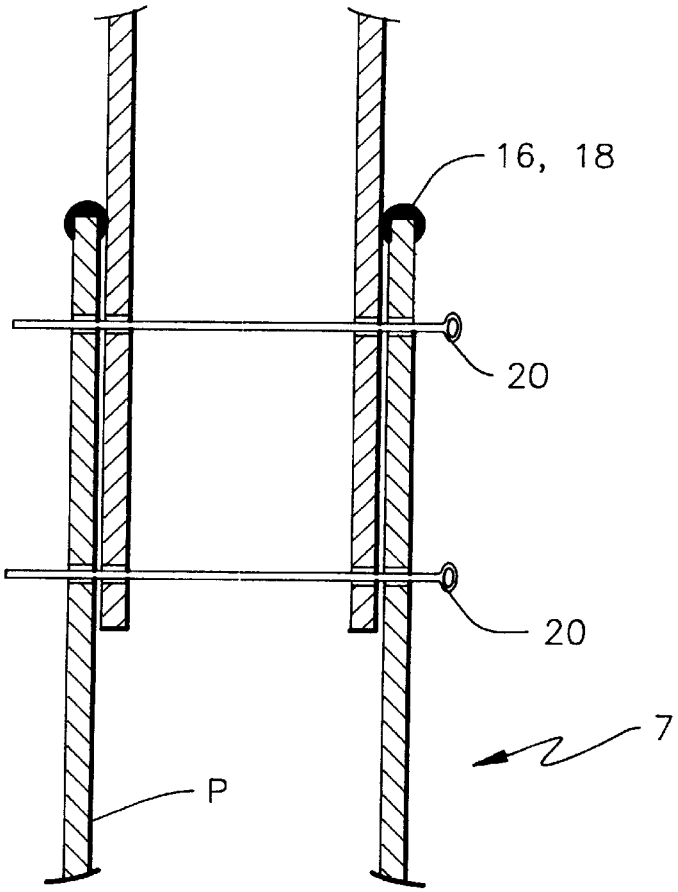
FIG. 4 is a cross sectional view of the pole inserted into the pole support member along line 2*a*—2*a* illustrating the use of a locking pin.

Now referring to FIG. 4, a contemplated embodiment is illustrated in which the openings 15,17 are be fitted with grommets 16,18 to ensure a tighter fit and aid in noise reduction. A locking pin 20 can be used to secure the pole 13 within the Pole support member 7. The number of locking pins 20 used is not critical as long as one such pin is used. Another consideration is that the pole 13 needs to be inserted into pole support member 7 far enough to ensure stability and minimize stress. Typically, the pole 13 should be inserted to a point P that is at least 5 times the diameter of the openings 15,17. Shorter insertions are contemplated with material with increased rigidity.

Support Strap Assembly

Referring now to FIG. 1, the support strap assembly 9 is a means of securing the pole support member 7, and therefore the flash assembly 5, to the worker 19. The support strap assembly 9 comprises a series of straps 21, 23, 25, 27 that are fastened around the body of the worker 19.

Power Pack

The power pack 11 is used to supply power to at least one signal light 29 via at least one pair of wires 31. The signal light can produce either a steady beam of light 33 or can be made into a strobe depending upon the desired embodiment. Circuitry for either embodiment is well known in the art. In some embodiments the signal light 33 can be powered by a locally attached power pack 35 that is located on the top pole end 43 of the pole 13. As with the other components of the instant invention 1 the power pack 11 should be of weatherproof construction.

In the preferred embodiment the power pack 11 is a conventional battery sized to power the selected light bulbs. Rechargeable batteries would be cost effective and should be used when possible.

Flash Assembly

Figure 5:
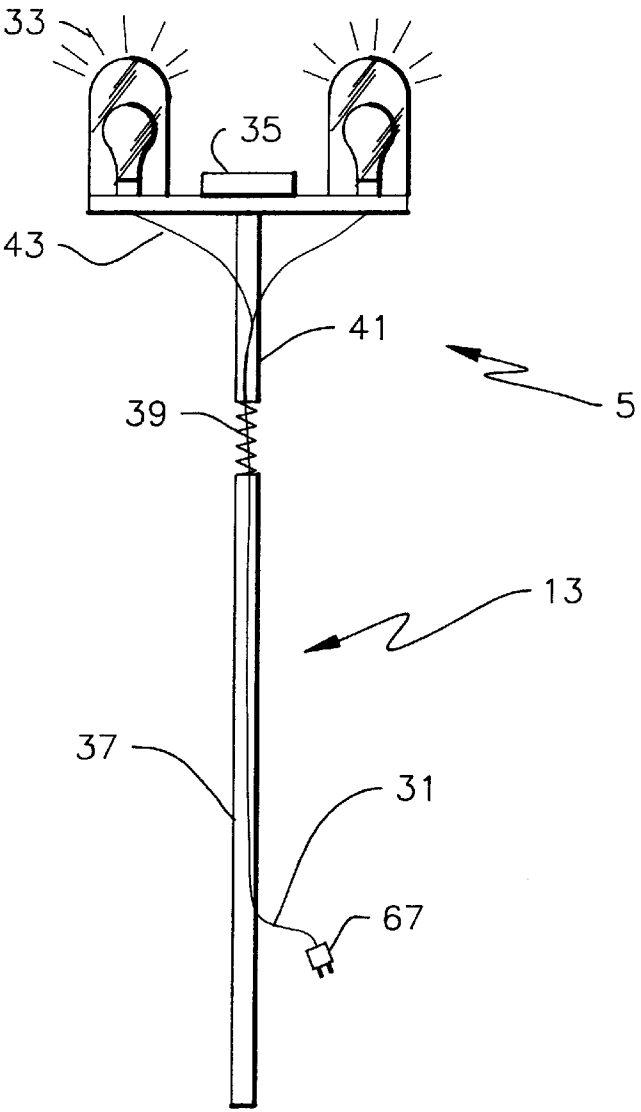
FIG. 5 is a side view of the light assembly.

Now referring to FIG. 5 the flash assembly 5 has a bottom section 37, a flexible joint 39, and an upper section 41, as well as a top pole end 43 and a bottom pole end 45. The flexible joint 39 allows for side to side motion of the bulb 49 increasing the noticeability for approaching motorist.

Figure 7:
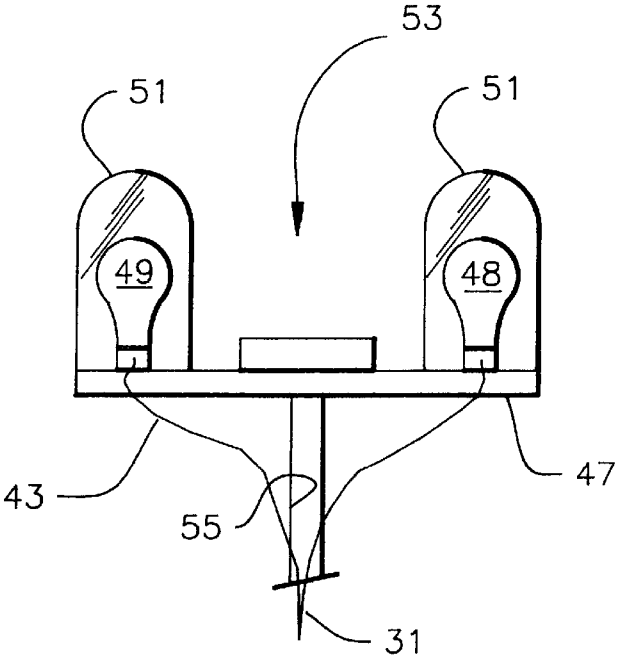
FIG. 7 is a side view of the bulb assembly.

Referring to FIG. 7, attached to the top pole end 43 is a bulb assembly support 47 that supports at least one bulb 49 and bulb cover 51. The weight of the bulb assembly 53 and movement of the pole 13 causes the flexible joint 39 to allow movement of the bottom section 37 with respect to the upper section 41. A typical spring can be used as the flexible joint 39. The spring would be sized to allow movement without breakage of the flexible joint 39. Factors to consider in sizing the spring would be: weight of the bulb assembly 53, relative lengths of the upper section 41 and the lower section 37, and diameter of the pole 13. The wire 31 can be ran down the outside of the pole 13, or down the pole interior 55 if a hollow pole is used.

Figure 6:
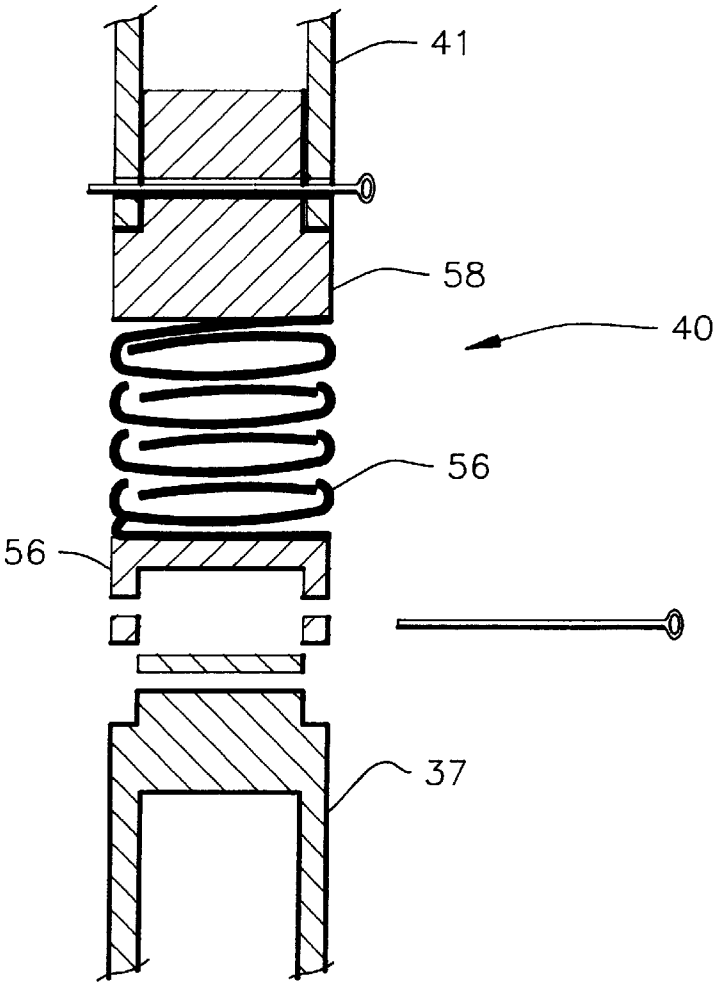
FIG. 6 is a cross-sectional view of the flexible coupling.

Now referring to FIG. 6, another embodiment is illustrated in which a removable flexible joint assembly 40 is used. The flexible joint typically comprises a spring 56, male connection 58, and a female connection 60. A contemplated means of connection is a locking pin 20 that is well known in the art. With the flexible coupling removed the bottom section 37 fits into the top section 41 and may likewise be locked into position by a locking pin 20. Additionally, a non-removable flexible coupling 39 can be used. A locking device that is known in the art (not shown) can be used to immobilize the flexible coupling 39 if desired.

Instead of a light assembly many different types attention getting devices can be used. For example, instead of lights commonly accepted signals shapes can be used. Examples includes: the octagon for stop signs, the triangle for yield, etc. Bright colors would be particularly beneficial since easy visibility is a desired result of utilization of the instant invention 1.

Construction of the Harness Assembly

Construction of harnesses is well know in the art. As with most harness assemblies of this type it should be designed to be worn over jackets, such as rain coats or winter jackets.

However, there are several key points that are of particular importance for successful use of the instant invention. The optimum number of vertical straps 21,23 is two, but any other number may be used. The heavier the pole the larger number of straps that should be considered. Two vertical straps 25,27 yields the optimum stability, additional vertical straps could add additional stability. However, for particularly heavy flash assemblies additional groin straps (not shown) may be used.

The power pack 11 is typically suspended from the lower horizontal harness. Consideration should likewise be given to preferential hand of the worker.

Another contemplated embodiment is that the harness be made into a jacket or other outer garment.

Construction of the Power Pack

Figure 8:
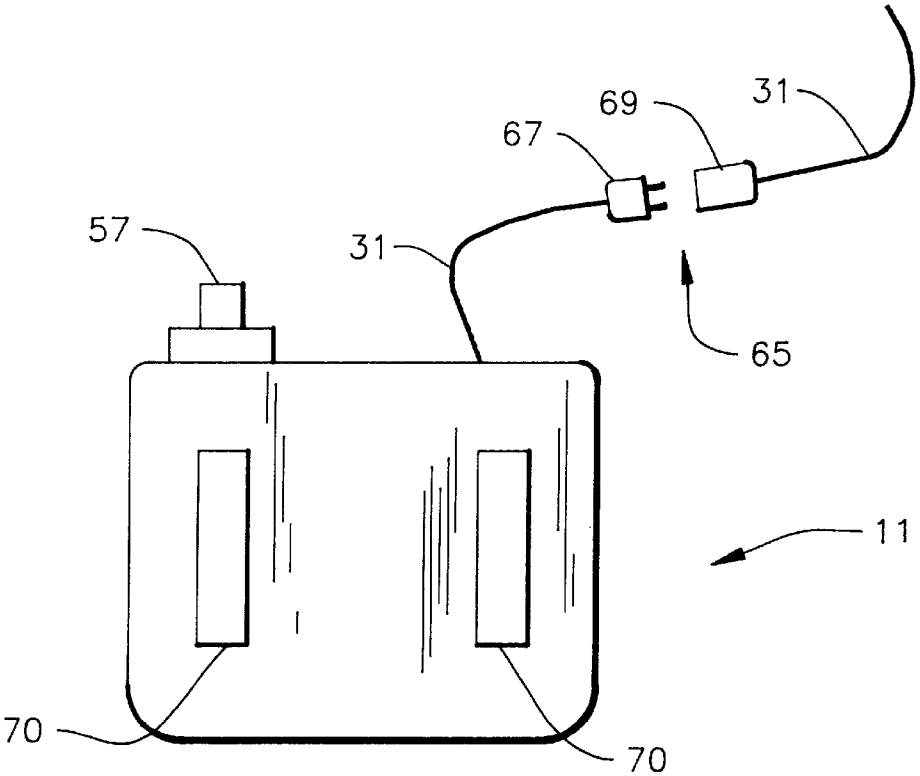
FIG. 8 is a rear view of the power pack.
Figure 9:
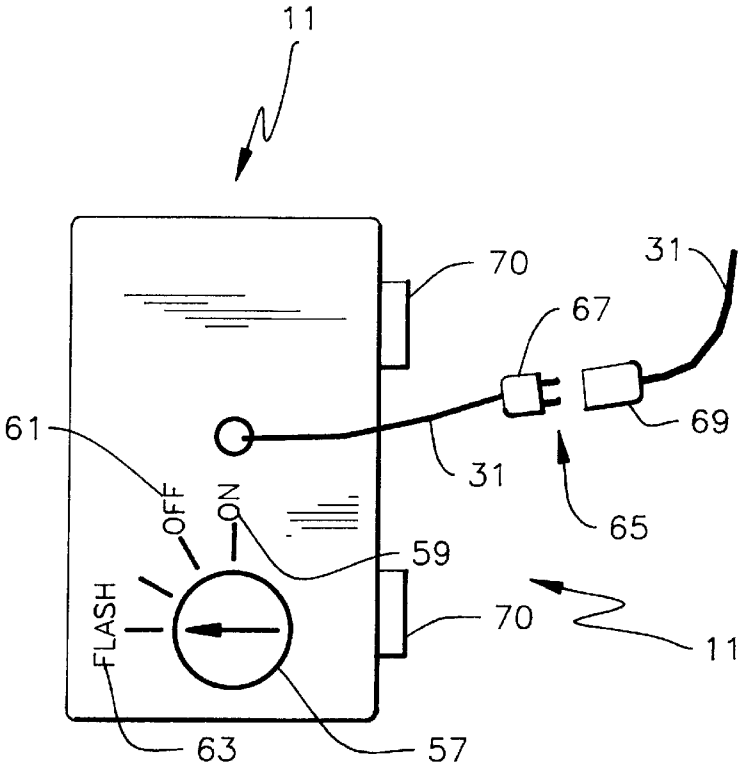
FIG. 9 is a top view of the power pack.

Now referring to FIG. 8 and FIG. 9, the power pack 11 is controlled by a switch 57. The switch will typically have at least two positions, on 59 and off 61. More positions can be used, depending upon the embodiment. For example, a flash position 63 would be needed if a strobe type bulb assembly 53 is used.

For changing the type of power pack 11, or simply to replace a power pack 11 whose charge has ran down, a coupling 65 should be provided to enable separation of the flash assembly from the power pack. The coupling 65 will typically have a male portion 67 and a female portion 69.

The power pack 11 can be directly attached to the harness assembly, or in the alternative it can be attached via a least one loop 70 through which a horizontal strap 21,23 can be inserted.

Due to the anticipated outdoor use of the instant invention 1 the coupling 65 should be water proof. For heavier power packs 11 attachment directly to the pole support member 7 should be contemplated.

Use of the Highway Worker Safety Signal Device

For a worker 19 to put on the preferred embodiment of the instant invention 1 the lower strap 21 should be fastened around the waist of the worker 19 first. Next the upper horizontal strap 23 should be secured around the chest of the worker 19. Fastening is done by an end fastening means, which is typically done by inserting the horizontal loose ends 22,24 into buckles 26,28. Then the loose ends 71,73 of vertical straps 25,27 are fastened into buckles 75,77. Other types of fastening means can be used.

The bottom end 45 of the pole 13 is then placed into either the first opening 15 or the second opening 17. If the worker is left-handed then the pole 13 should placed into the second opening 17. Accordingly, if the worker 19 is right-handed then the pole 13 should be placed into the first opening 15. It is anticipated that two pole can be used with the preferred embodiment of the instant invention. Any combination of steady lights 49 or strobe lights 49 can be used atop the poles 13.

Weather Proof Containment

Figure 10:
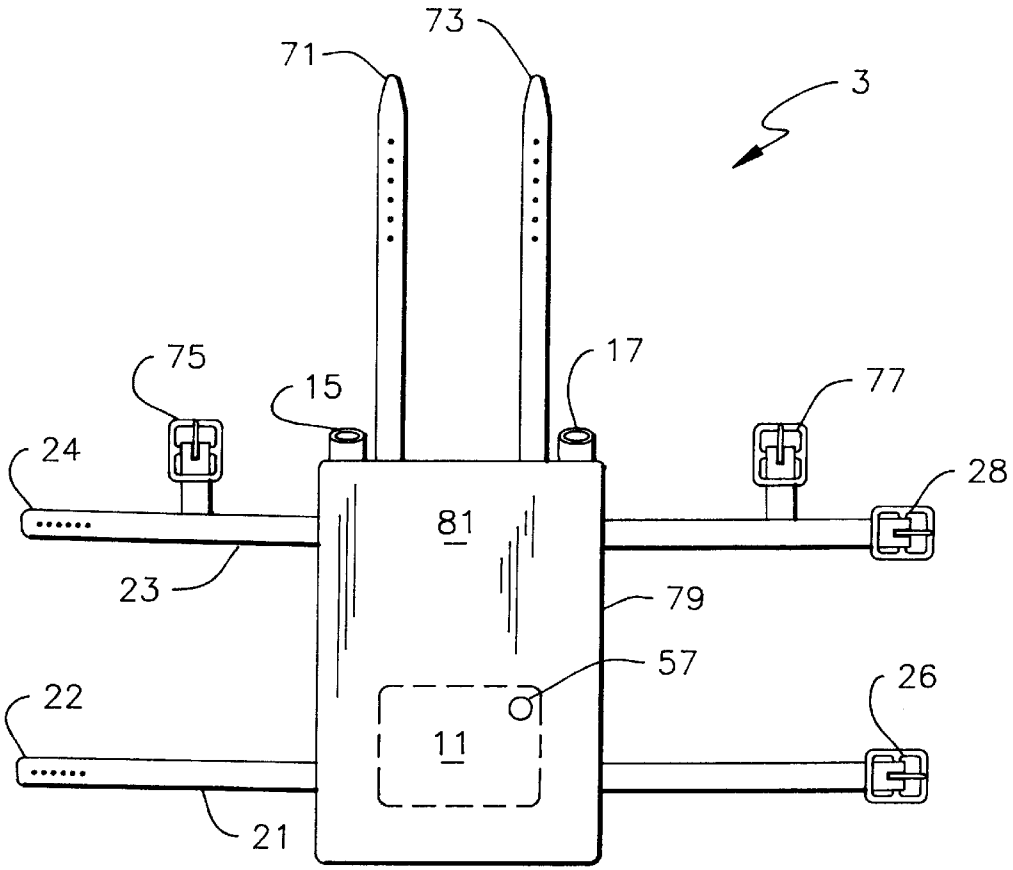
FIG. 10 is a side view of instant invention illustrating the weatherproof containment.

Referring to FIG. 10, still another embodiment of instant invention 1 is where the pole support member 7 and the power pack 11 is enclosed within a weatherproof containment 79. The switch 57 is located as to be assessable to the worker on the outside surface 81 of the weatherproof containment 79.

Other Embodiments Possible

While several embodiments of the present invention have been shown and described, it will be apparent to those skilled in the art that many changes and modifications may be made without departing the invention in its broader aspects.

I claim:

1. A highway worker safety signal device comprising:

a harness assembly having:

a pole support member having at least one opening, said pole support member attached to a support strap assembly;

said support strap assembly having at least one horizontal strap and at least two vertical straps, each strap having an end fastening means;

a power pack attached to said support strap assembly, said power pack electrically attached to a signal light;

a flash assembly having at least one said signal light affixed on an upward position of a pole, said pole having a top pole end, a flexible joint, and a bottom pole end;

said flexible joint being attached between said top pole end and said bottom pole end, said signal light attached to said top pole end; said flexible joint includes a spring to allow side to side motion of the signal light;

said bottom pole end is inserted into said opening, whereby when said harness assembly is worn by a worker, the highway worker's visibility is enhanced.

2. The apparatus of claim 1, wherein said pole is held securely within the opening of said pole support member by a locking pin.

3. The apparatus of claim 2, wherein said opening of said pole support member comprises a first opening and a second opening.

4. The apparatus of claim 1, wherein said flash assembly contains a strobe light.

5. The apparatus of claim 1, wherein said pole support member is reenforced by a cross-beam.

6. A highway worker safety signal device comprising:

a harness assembly having:

a pole support member having a first and a second opening, said pole support member attached to a support strap assembly;

said support strap assembly having at least one horizontal strap and at least two vertical straps, each strap having an end fastening means;

a power pack attached to said support strap assembly, said power pack electrically attached to a flash assembly;

the flash assembly having at least one signal light affixed atop a pole, said pole having a top pole end, a flexible joint, and a bottom pole end;

said flexible joint being attached between said top pole end and said bottom pole end; said flexible joint includes a spring to allow side to side motion of the signal light;

said bottom pole end is inserted into either said first or second opening, whereby when said harness assembly is worn by a worker, the highway worker's visibility is enhanced.

7. The apparatus of claim 6, wherein said power pack has a switch to operate said signal light.

8. The apparatus of claim 7, wherein said switch has positions for on, off, and flash.

* * * * *